United States Patent [19]

Burrell et al.

[11] 4,013,006

[45] Mar. 22, 1977

[54] ROLL-FED SHEET PRINTING APPARATUS

[75] Inventors: Dale F. Burrell; Alan Strihafka, both of Kennesaw, Ga.

[73] Assignee: Burrellco, Inc., Kennesaw, Ga.

[22] Filed: July 9, 1975

[21] Appl. No.: 594,496

[52] U.S. Cl. ..... 101/227; 101/73; 83/94; 83/602

[51] Int. Cl.[2] ..... B41F 13/56

[58] Field of Search ..... 101/233, 234, 181, 224, 101/226, 227, 73, 74; 83/61, 73, 208–210, 360, 363, 369, 370, 602, 94

[56] References Cited

UNITED STATES PATENTS

| | | | |
|---|---|---|---|
| 2,877,846 | 3/1959 | Tobey | 101/227 X |
| 2,963,965 | 12/1960 | Baumgartner | 101/227 |
| 3,052,182 | 9/1962 | Dyke | 101/142 |
| 3,072,051 | 1/1963 | Lincon et al. | 101/227 |
| 3,159,521 | 12/1964 | Pechmann | 101/227 X |
| 3,482,477 | 12/1969 | Sleeper | 83/94 |
| 3,552,308 | 1/1971 | Minehart | 101/74 X |
| 3,808,406 | 4/1974 | Oberg et al. | 101/248 |
| 3,890,893 | 6/1975 | Kodis | 83/602 X |

*Primary Examiner*—Edward M. Coven

[57] ABSTRACT

Printing apparatus which receives printing stock in roll form, withdraws a predetermined amount of material from the roll, cuts the withdrawn material to provide a sheet of stock for printing, and then feeds the sheet to a printer. The printing apparatus can overprint onto sheets which are cut from a roll of preprinted stock, or can print on sheets which are measured and cut from blank roll stock. When used with preprinted stock including a printed material code, the printing apparatus reads the material code to verify that the proper printing stock is being used, and automatically interrupts the printing operation if the proper stock is not present.

2 Claims, 6 Drawing Figures

PULSE GEN.
PULSE COUNTER
COMPARATOR
SET INPUT
RESET
REG. P.C.
LAMP
YES
NO
CODE SELECT
CODE RESET
CODE TIMER
INCORRECT CODE
SHEET COUNTER
TRANSPORT
SHEAR
EMER. STOP
HOLD
RR-3
RR-2
RR-1
RR
REGIS. DELAY
SHEAR VALVE
PRINT VALVE
LOCK OUT
TO SWITCHED POWER
BRAKE-CLUTCH CONTROL
TO PRESS
CLUTCH
BRAKE
POWER
SD
SD-1
SD-2
SHEAR DWELL TIMER
PD-1
PRINT DWELL TIMER

ROLL-FED SHEET PRINTING APPARATUS

This invention relates in general to printing apparatus and in particular to printing apparatus which can provide individual sheets of printed material from printing stock in web form.

The numerous types of production-volume printing apparatus that are known to the art can be roughly classified as sheet-fed printers or roll-fed printers. The sheet-fed printers, which include such well-known apparatus as the offset press and the mimeograph machine, are generally supplied with a quantity of separate sheets of paper or other printing stock that were previously cut from suitable stock. The sheet-fed printer takes one sheet at a time from the sheet supply, usually through a suitable sheet feeding mechanism, and prints the sheet. While sheet-fed printers may be relatively economical to purchase and operate, such printers require printing stock in precut sheet form.

Roll-fed printing apparatus, such as the high-speed rotary presses used in modern newspaper printing applications, receive printing stock in roll form and pass an uncut web of stock through a rotary press which repetitively prints pages or other units of material. The printed web is then cut, and possibly folded or otherwise manipulated, after the printing operation is completed. Such conventional roll-fed printing apparatus, while capable of relatively rapid printing speed, is relatively expensive to purchase and is uneconomical for relatively low-volume printing jobs.

There are many printing applications wherein it is desirable to combine the convenience of roll feeding with the advantage of a printing apparatus which receives and prints one sheet of stock at a time. For example, package labels or an entire panel of a package may be printed on continuous rolls of printing stock in a high-volume continuous printing operation, inasmuch as all packages of a product will bear certain common information such as the manufacturer's name, product, name, product ingredients, and the like. The individual labels or package sheets must also be imprinted with information applicable only to a small subset of the product to be packaged, however, such as lot number information, expiration date, or the like. Since this individualized information must be applied only to a relatively small quantity of the preprinted labels or package sheets on a roll, the rolls of label or package stock have heretofore been manually cut into separate sheets of a size suitable for acceptance by a conventional sheet-fed printing apparatus which is equipped with a printing plate or the like containing the desired individualized information for printing on a lesser number of the sheets.

According to the present invention, there is provided an automatic roll-fed printing apparatus which receives a continuous web of either preprinted or blank stock, withdraws a predetermined length of stock from the web, cuts off the withdrawn stock to form a separate sheet, and delivers the sheet to a sheet-fed printer which may be of substantially conventional design. The apparatus of the present invention includes means for sensing stock identification indicia which may be preprinted on the continuous web of stock so that the apparatus can function only if supplied with a previously-determined proper type of stock. The apparatus of the present invention is readily useable with a wide variety of plain or coated stock materials, whether preprinted or blank, including paper, plastic, metal foil, and other web fed materials.

Accordingly, it is an object of the present invention to provide improved printing apparatus.

It is another object of the present invention to provide printing apparatus which accepts a continuous web of printing stock, which withdraws and severs a predetermined amount of stock from the web to form a separate sheet of stock, and which then prints on the severed sheet.

It is another object of the present invention to provide a relatively inexpensive apparatus for automatically providing printed separate sheets of material from a continuous web of printing stock.

Other objects and advantages of the present invention will become more readily apparent from the following description of a disclosed illustrative embodiment thereof, including the drawings in which.

Figure 1:
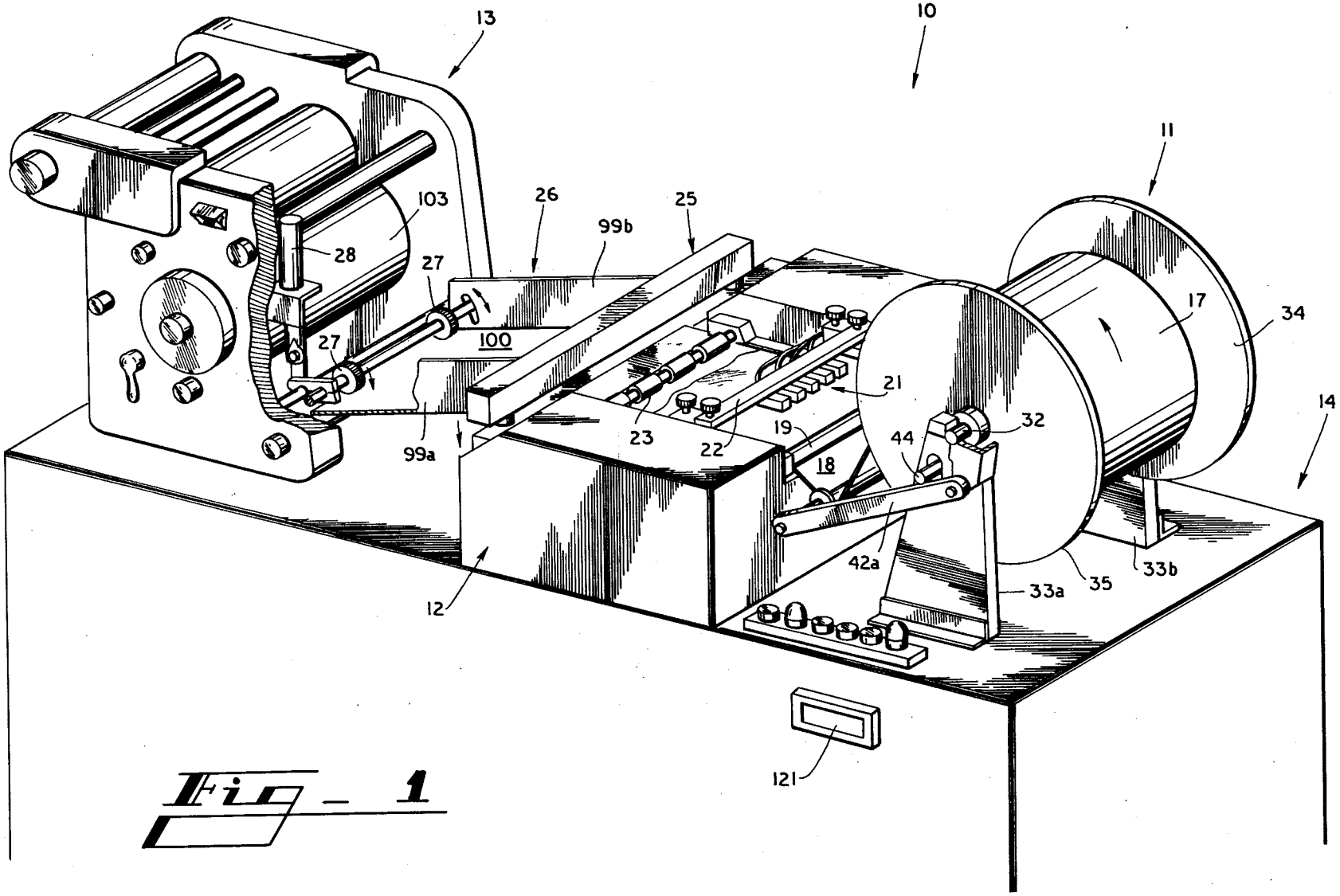
FIG. 1 shows a pictorial view of apparatus according to the disclosed illustrative embodiment of the present invention.

Turning to the overall pictorial view of FIG. 1, the disclosed embodiment according to the present invention of printing apparatus 10 includes the roll feeding apparatus indicated generally at 11, the printing stock transport assembly shown generally at 12, the shear 25, and the printer shown generally at 13, all of which are preferably mounted on a common base assembly shown generally at 14. The base assembly 14, in addition to providing a common structural support for the aforementioned mechanical components of the printing apparatus, also contains the electrical and mechanical control apparatus for the present invention; the base assembly 14 may be mounted on casters (not shown) to give the printing apparatus a degree of portability.

The roll feeding apparatus 11 supports a continuous web of any suitable printing stock in the form of a roll 17, from which the continuous web 18 is withdrawn by the transport assembly 12 in a manner described below. Although the continuous web of printing stock is supplied in the form of a roll in the disclosed embodiment, it will be understood that alternative web feeding apparatus may be substituted where the desired printing stock is provided in other than roll form.

The transport assembly 12 includes an upper infeed roller 19 and a lower infeed roller 20, between which passes the web 18 of printing stock. The web 18 passes beneath the code scanning assembly 21 which is carried on the overhanging bar 22, and then is drawn between the upper outfeed roller 23 and the lower outfeed roller 24 to pass between the blades of the shear 25. The printing stock upon being cut by the shear 25 as explained hereinbelow, resides in the infeed tray 26 of the printer 13 in position beneath the infeed rollers 27 associated with the printer 13. The infeed rollers of the printer are periodically moved into engagement with the paper sheet by the infeed actuator 28, thereby allowing each separate sheet to be fed into the printer in proper timed relationship.

Figure 2:
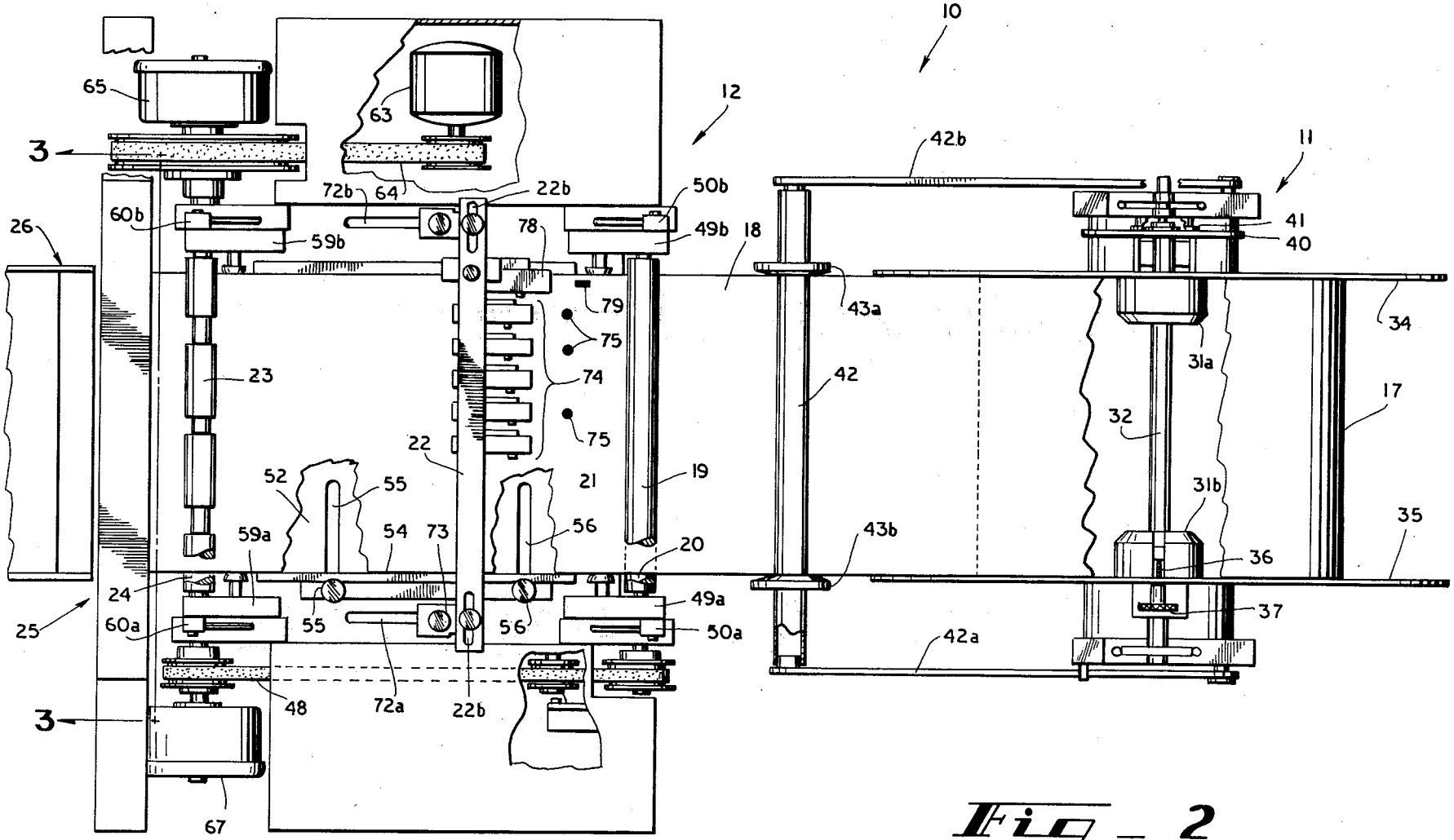
FIG. 2 is a top plan view of a portion of the apparatus shown in FIG. 1.

Returning to the details of the roll feeding apparatus 11 as best seen in FIGS. 1 and 2, the hollow-core roll 17 of printing stock is received on a pair of hubs 31*a* and 31*b* mounted on the shaft 32 which is rotatably supported on a pair of upright members 33*a* and 33*b*. The hub 31*b*, to which is attached the side plate 35, is adjustably supported on the shaft 32 by the threaded spindle 36 to which is attached the adjusting knob 37. The side plate 34 is permanently supported by the hub 31*a*. The spacing between the two side plates 34 and 35 can be varied by turning the knob 37 so that the spindle 36, and thus the hub 31*b* and the side plate 35, are axially displaced along the shaft 32. Thus, rolls 17 of different widths can be accommodated.

The outer ends of the shaft 32 are mounted on freely rotating bearings, and the shaft is provided with a drag brake including the shaft-connected disc 40 which is contacted by the selectively adjustable pressure pad 41. It will be understood that the drag brake is necessary to prevent the reel 17 of printing stock from free-wheeling by established momentum, during intervals when the transport assembly 12 is not withdrawing the web from the roll.

Tension in the web 18 is maintained by the dancer arm roller 42 mounted at the outer ends of the dancer arms 42*a* and 42*b*, the other ends of which are attached to the upright members 33*a* and 33*b* for a degree of oscillating movement relative thereto. The dancer arm roller 42 is normally disposed above the web 18 feeding from the roll 17 into the infeed rollers 18 and 19 of the transport assembly 12, so that the weight of the dancer arm roller prevents the web 18 from becoming slack from the absence of tension at that point. A pair of roller guides 43*a* and 43*b* are provided on the dancer arm roller 42 to guide movement of the web 18 thereunder. A stop pin 44, located above the pivotally-attached end of the dancer arm 42*a* on the upright member 33*a*, limits the maximum upward movement of the dancer arm roller during operation of the roll feeding apparatus. The stop pin 44 can be displaced from the arm blocking position, if desired, so that the dancer arm roller can be manually pivoted upwardly to facilitate threading the web 18 through the transport assembly 12.

Figure 4:
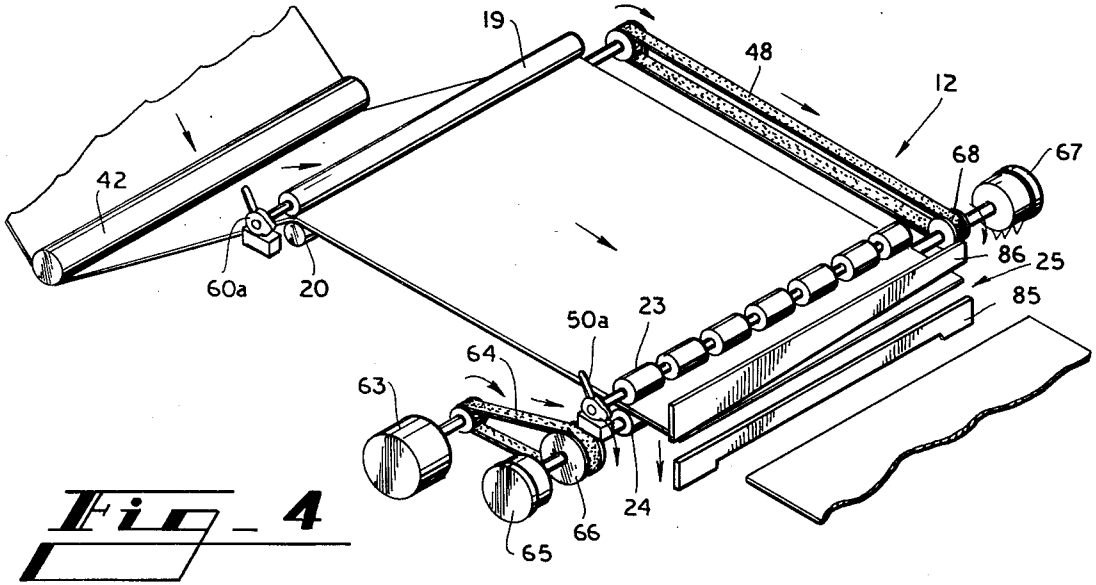
FIG. 4 is a semi-schematic view showing the stock transport and cutting portion of the disclosed embodiment.

The transport assembly 12, best seen in FIGS. 2 and 4, includes the aforementioned two infeed rollers 19 and 20, with the lower infeed roller 20 being driven by the belt 48. The upper infeed roller 19 is freely rotatable between the pair of support blocks 49*a* and 49*b*, each of which is provided with a vertical adjustment device such as the cams 50*a* and 50*b* for providing the upper infeed roller 19 with a limited degree of vertical adjustment. The web 18 is normally pinched between the upper and lower infeed rollers 19 and 20 so that the upper infeed roller is rotated by movement of the web thereunder; the upper infeed roller can be raised by the adjusting cam 50*a* and 50*b* to a limited extent necessary for threading the web 18 between the two infeed rollers.

The transport assembly 12 includes the bed 52 on which the web 18 passes between the infeed rollers and the outfeed rollers. The path of the web 18 is also defined by the fixed edge guide 53, and by the adjustable edge guide 54 which is attached to the bed 52 with bolts extending downwardly through the transverse elongated slots 55 and 56 extending partway across the width of the bed. The thumb nuts 55 and 56 allow the attachment bolts to be loosened while the adjustable edge guide 54 is positioned for the desired web width.

The upper outfeed roller 23 is supported for free rotation between the two support blocks 59*a* and 59*b*, and the support blocks are provided with vertical adjustment cams 60*a* and 60*b* which allow the vertical outfeed roller 23 to be raised out of web-pinching pressure engagement against the lower outfeed roller 24, in a manner similar to the previously described arrangement of infeed rollers.

The lower outfeed roller 24 is selectively driven for rotation by a power train including the motor 63, the drive belt 64, and the clutch 65 which selectively connects the input pulley 66 to the lower outfeed roller 24. The opposite end of the lower outfeed roller 24 is connected to the selectively operable rotation brake 67, and the drive belt 48 to the lower infeed roller 20 is driven by the pulley 68 which is mounted for rotation by the lower outfeed roller 24. The clutch 65 and the brake 67 are preferably remotely-actuated units which are selectively actuated by the appropriate application of an electrical or pneumatic signal, for example, so that the clutch and the brake can be simultaneously operated in the manner described below. It will be understood that when the clutch 66 is engaged and the brake 67 is released, the two lower feed rollers 20 and 24 are driven to move the web 18 along the bed 52 of the transport assembly. When the clutch 65 is disengaged and the brake 67 is applied, both of the lower feed rollers are stationary and movement of the web 18 through the transport assembly is immediately arrested. The diameter of the driven lower infeed roller 20 may be slightly less than the diameter of the driven lower outfeed roller 24, so that the web 18 between the two rollers is always maintained in tension.

The code scanning assembly 21 is suspended above the bed 52 on the spanning bar 22, which is mounted on the support blocks 72 and 73 with adjustment slots 22*a* and 22*b* to provide an extent of lateral adjustment across the width of the bed 52. The two support blocks 72 and 73 are longitudinally adjustable a distance between the infeed and outfeed rollers, by means of the slots 72*a* and 72*b*.

The code scanning assembly 21 includes a number of separate web scanning elements collectively indicated at 74 in FIG. 2. The several scanning elements 74 are intended to detect the presence or absence of coded indicia which may be present on the web 18. In the disclosed embodiment of the invention, the coded indicia on the web take the form of black spots or bars which are present on an otherwise-white web background, and so the scanning elements 74 are reflected light photocell scanners which provide a first type of output signal in the presence of a black code spot and a second type of output signal in the absence of a black code spot. Reflected light scanning apparatus is known to those skilled in the art, and need not be described herein in further detail.

Five separate codes scanning elements 74 are mounted on the bar 22 in lateral array across the width of the bed 52, although it will be understood that a greater or lesser number of scanning elements can be employed depending on the number of separate code spot locations to be sensed. Three separate "black" code spots 75 are depicted on the web in FIG. 2, just before reaching the first, second, and fourth individual code scanning elements 74 (counting from the edge guide 53).

Also mounted on the bar 72 is the registration scanner 78, which functions to provide an identifiable control signal condition when a black or otherwise-unique registration bar 79 on the web 18 is sensed. The registration scanner 78 can also be a reflected-light photocell scanner, where appropriate.

Figure 3:
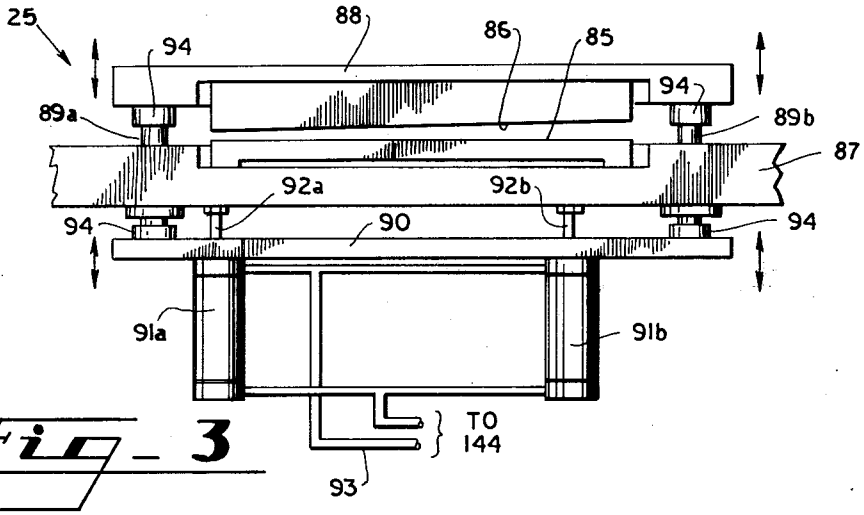
FIG. 3 is a section view taken along line 3—3 of FIG. 2, showing detail of the stock cutting apparatus.

The shear 25, which is positioned beyond the bed 52 of the transport assembly, includes a lower shear blade 85 mounted on the lower shear frame 87 and an upper shear blade 86 mounted on the upper shear frame 88. The upper and lower shear frames are selectively movable, one relative to the other, and in the disclosed embodiment the upper shear frame 88 and attached blade 86 are mounted for vertical reciprocation with respect to the lower shear frame 87 and the lower shear blade 85. The upper shear frame 88 is supported by a pair of guide bars 89*a* and 89*b* which are reciprocable within appropriate bearing passages through the lower shear frame 87. The lower ends of the guide bars 89*a* and 89*b* are connected to the support member 90, and the actuators 91*a* and 91*b* are interconnected between the support member 90 and the lower shear frame 87. The actuators 91*a* and 91*b*, in the disclosed embodiment of the present invention, are double-action fluid operated cylinders which are secured to the support member 90 and which have operating rods 92*a* and 92*b* extending upwardly for attachment to the lower shear frame 87. The fluid-powered cylinders 91*a* and 91*b* are connected for operation in parallel by fluid conduits 93 which extend to a suitable operating valve, as discussed below. Each end of the two guide bars 89*a* and 89*b* may be surrounded with bumpers 94 made of a suitable resilient material to cushion the upward and downward travel of the upper shear frame 88. The upper shear frame is maintained in the upper position between shearing operations by fluid pressure applied to contract the operating rods 92*a* and 92*b*, as shown in FIG. 3.

Figure 5:
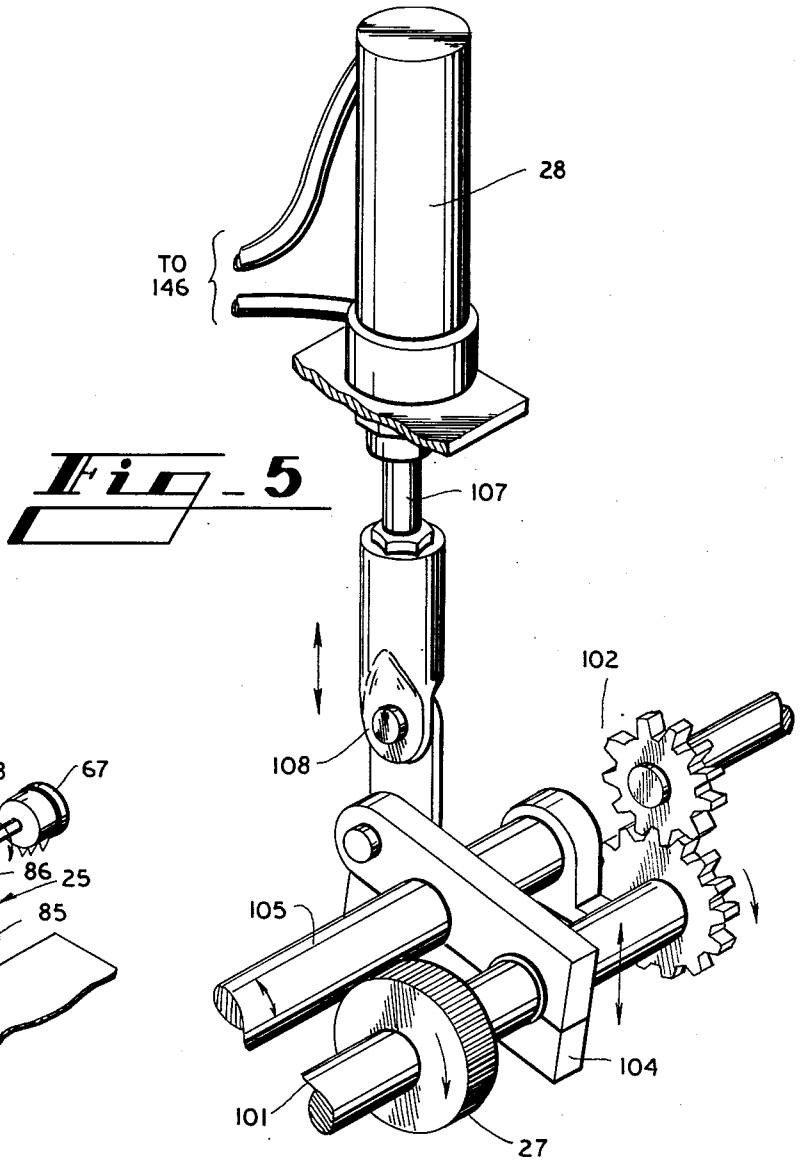
FIG. 5 is a fragmentary pictorial view of the apparatus for controlling feeding of cut sheets into the printer.

The infeed tray 26 (FIG. 1) may be the stock feed tray of the type which is commonly provided with conventional printers 13 such as offset presses and the like, and includes a pair of side walls 99*a* and 99*b* and a floor 100 for receiving printing stock which has been fed through the shear 25. The infeed rollers 27, both of which are shown at 27 generally in FIG. 1 and one of which is shown in detail in FIG. 5, are typically present on standard presses and are secured to a roller shaft 101 which is driven through a suitable drive train (only partially shown at 102 in FIG. 5) including an intermittent drive which is synchronized with the rotary printing drum 103 for sheet feeding rotation in timed relation to the rotation of the printing drum. The infeed rollers 27, it will be understood by those skilled in the art, thus function to feed a sheet from the infeed tray 26 into the printer at the proper time for printing the sheet in synchronism with the printing drum 103.

While the aforementioned intermittent rotation of the infeed rollers 27 is unchanged in the disclosed embodiment of the present invention, the infeed rollers are suspended above the floor 100 of the infeed tray 26 during intervals of each operating cycle for a reason which is explained below. To accomplish selective positioning of the infeed rollers, the roller shaft 101 is rotatably extended through the bracket 104 which is secured to the rocking shaft 105. An actuator 106, which may be a fluid-powered cylinder, has an operating rod 107 interconnected through the linkage 108 to the rocking shaft 105, so that the shaft 105 undergoes a predetermined extent of oscillation as the operating rod 107 is extended and retracted. The oscillation of the rocking shaft 105 in response to the operation of actuator 106 is selected so that the infeed rollers 27 are movable between a sheet feeding position, in which the rollers 27 frictionally engage a sheet within the infeed tray 26, and an upper position in which the rollers 27 are elevated above the floor 100 of the infeed tray.

Figure 6:
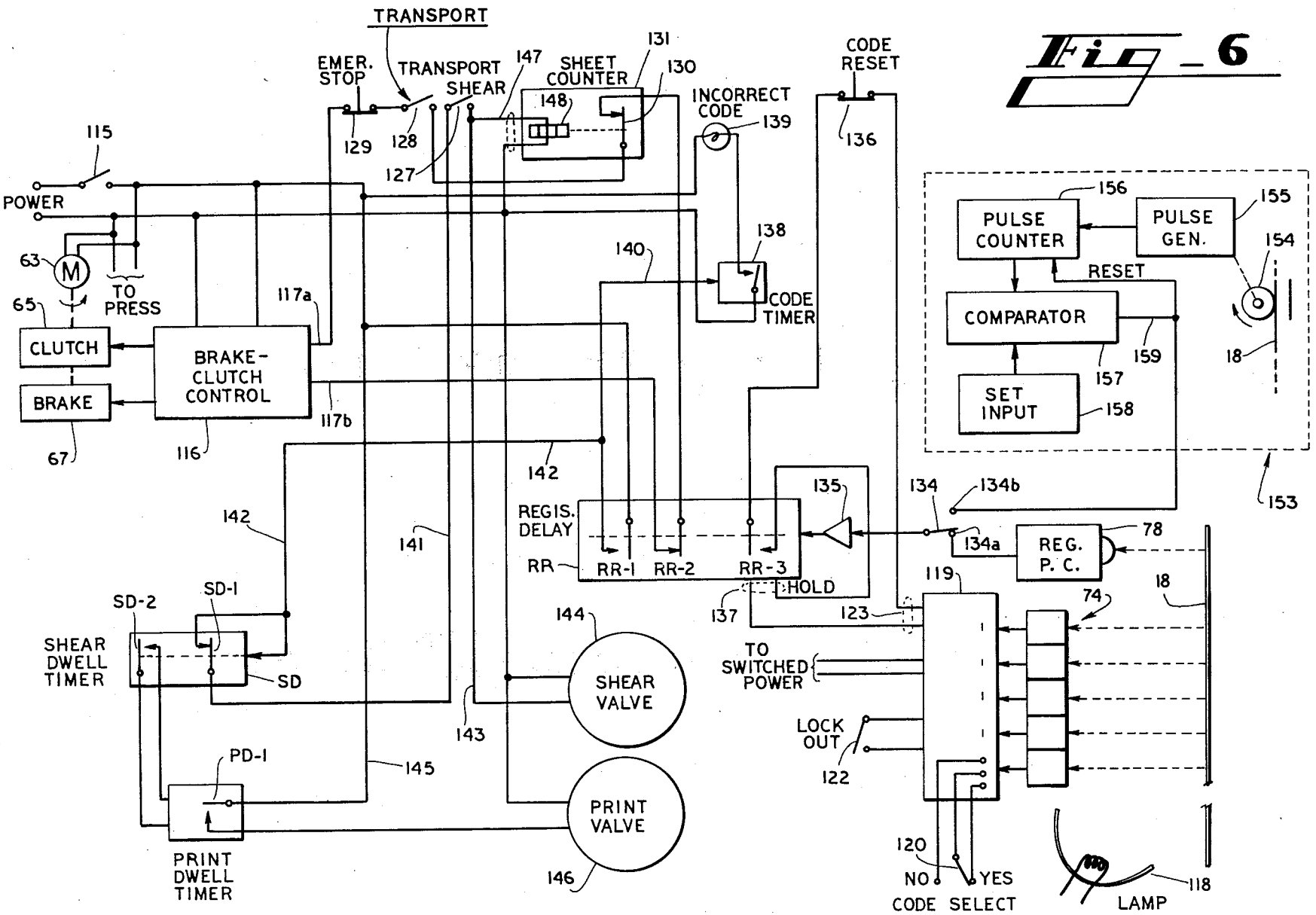
FIG. 6 is a schematic diagram of electrical control circuitry used in the disclosed embodiment.

The electrical control circuit used with the disclosed embodiment of the present invention is schematically depicted in FIG. 6. Electrical power from a conventional AC power source is supplied through a master switch 115, which controls power to the entire electrical system including the operating motor for the printer 13 and the aforementioned motor 63 for the transport assembly 12. Power is also supplied to the brake-clutch control 116, which selectively supplies control power to the clutch 65 and the brake 67 in response to appropriate control signal conditions supplied along the lines 117*a* and 117*b*. Since the clutch 65 and the brake 67 are operated in the aforementioned mutually exclusive manner, it will be understood that the brake-clutch control can be any appropriate switching apparatus which causes engagement of the clutch and simultaneous release of the brake, in response to a first signal condition on the control lines 117*a* and 117*b*, and which reverses the aforementioned clutch-brake condition in response to a second signal condition on the control lines.

The registration scanner 78 is schematically shown in position to receive illumination which is reflected from a location adjacent one longitudinal edge of the web 18, which in FIG. 6 is shown in cross-section in a plane perpendicular to the drawing sheet. The several individual code scanning elements 74 are also shown in position for scanning the web 18 to detect the presence or absence of code spots, as previously mentioned. Since the registration scanner 78 and the code scanning elements 74 are provided by photocells in the disclosed embodiment, it may be desirable to illuminate the web area which passes beneath these scanners with a suitable source of illumination 118.

Each of the code scanning elements 74 is connected to the code scanner control 119 which operates to compare the code scanner signals with preset signals corresponding to a previously-determined desired code condition. The code scanner control 19 produces appropriate output signal conditions indicating either the presence or the absence of a "correct" code condition on the web 18. Code scanner control apparatus which includes the foregoing functions is available in the art, with one such apparatus being available from General Electric Company as Part No. 357505PM530B1. The code condition corresponding to a correct sensing condition for each of the individual scanning elements 74 is provided by a single-pole double-throw code selector switch, with a typical code selector switch for one of the scanning elements being shown at 120. It will be understood that a separate code select switch 120 is necessary for each of the individual code scanning elements 74, so that five separate code select switches are in reality required for the disclosed embodiment which utilizes five code scanning elements. Each of the code select switches, which may be conveniently located within a control panel 121 on the base assembly 14 shown in FIG. 1, is positioned by the printing apparatus operator either to a "no" position, indicating that the desired correct code is the absence of a code spot for that element, or to a "yes" position indicating that the correct code for that spot is the presence of a code spot. The code scanner control is also preferably provided with a code lock-out switch 122 which renders the entire code scanning function inoperative when the present printing apparatus is used for printing blank stock, for example.

The code scanner control 119 has a pair of output lines 123 on which a first code control condition is present when the code spots sensed by the code scanning element 74 coincide with the correct code condition preset on the code select switches 120, and on which a different code control condition is present in the absence of a correct code. The correct code control signal may simply be the absence of any signal on the line 123, while the incorrect code control signal may be the presence of a control voltage on that line.

The remainder of the control circuit is now described with reference to the following operational description of the disclosed embodiment. The printing apparatus is initially loaded with a roll 17 of desired printing stock, which for the present example is assumed to be preprinted with code spots 75 and registration bars 79 as previously discussed. The dancer arm roller 42 is raised, and the two upper feed rollers 19 and 23 are elevated so that the leading edge of the printing stock web 18 can be threaded beneath the dancer arm roller, between the infeed rollers, and along the bed 52 and between the outfeed rollers until the leading edge of the web is closely adjacent to the shear 25. The adjustable edge guide 54 is positioned if necessary to provide proper alignment guidance of the web, and the two upper feed rollers 19 and 23 are lowered to pinch the web between the paired infeed and outfeed rollers. The dancer arm roller 42 is then lowered to approximately the position shown in FIG. 1, so that the weight of the roller keeps the web 18 taut. The positions of the code scanning elements 74 and the registration scanner 78 are checked and repositioned if necessary to ensure proper registration with the code spots 75 and the registration bar 9, respectively.

The master switch 115 is now turned on, and the shear switch 127 is also turned on at this time although the shear presently remains inoperative. The transport switch 128 is now closed, completing a circuit which includes the control line 117*a* from the brake-clutch control 116, the normally-closed emergency stop switch 129, the now-closed switch 130 of the sheet counter 131, the normally-closed relay contact RR2 of the registration delay relay RR, and the other control line 117*b* of the brake-clutch control. All relay contacts in the registration delay relay RR are shown in the normal or unenergized state, indicating that no registration bar is being sensed by the registration scanner 78.

The brake-clutch control 116 now operates in response to closure of transport switch 128 to engage the clutch 65 and simultaneously to disengage the brake 67, so that the motor 63 is coupled to drive the infeed and outfeed rollers of the transport assembly 12. It will be recalled that the blades of the shear 25 are maintained separated at this time, and so the leading edge of the web is advanced through the shear and into the infeed tray 26 of the press 13 by the present operation of the transport assembly. The infeed roller 27 is presently elevated above the floor 100 of the infeed tray.

Assuming that the registration scanner 78 is properly positioned, a registration bar 79 printed on the web 18 should appear beneath the registration scanner 78 at the time when the leading edge of the web has been fed into the printer infeed tray 26 far enough to be disposed beneath the now-raised infeed rollers 27. In response to the appearance of the registration bar 79, the registration scanner 78 sends a control signal through the selector switch 134 and the signal amplifier 135 to actuate the registration delay relay RR. The registration delay relay RR is now energized in response to the amplified signal from the registration scanner 78, and the registration delay relay includes a timed hold circuit which maintains the relay energized for a predetermined interval such as 0.5 seconds, in the illustrative embodiment of the invention. The relay contact RR2 is now opened, interrupting the previously-established control circuit to the brake-clutch control 116 and immediately stopping the web feed through the transport assembly 12.

The normally-open relay contact RR1 is also closed when the relay RR is energized, completing a circuit including the code output line 123 of the code scanner control 119, the normally-closed code reset switch 136, and the "hold" input circuit 137 of the registration delay relay RR. It will be understood that the hold circuit 137 may simply be provided by an additional set of relay contacts connected across the operating coil of the relay RR to maintain that relay energized in response to a holding voltage applied to the circuit 137.

If the preprinted code spots 75 now positioned beneath the code scanning elements 74 agree with the previously determined printing stock code entered into the code select switches 120, no signal is present on the code output line 123 and the registration delay relay RR will time out and become deenergized at the end of its regular delay interval. If the sensed code spots disagree with the predetermined correct code, however, a voltage is present on the code output line 123 at this time and this voltage is applied through relay contact RR1 to the hold circuit 137 and the code reset switch 136 so that the transport mechanism remains stationary until the code reset switch 136 is momentarily opened to break the hold circuit.

A circuit is now allowed to be established through closure of the normally-open relay contact RR3 and the code timer 138 to illuminate the incorrect-code lamp 139, calling the operator's attention to the sensed correct code. The incorrect code timer 138 provides a normally-open circuit which closes a predetermined time delay after receiving a control signal on the line 140. The delayed closing of the code timer 138 prevents the lamp 139 from illuminating during non-holding operation of the relay RR.

When the registration delay relay RR is energized by a signal from the registration scanner 78 indicating a sensed registration bar, closure of relay contact RR3 also applies a signal along the line 142 to the control input of the shear dwell timer SD, and to the normally-closed contact SD1. The shear dwell timer SD is a delayed-operation timer which opens the normally-closed contact SD1 and closes the normally open contact SD2 only after a predetermined delay time (approximately 0.2 seconds, in the illustrative embodiment of the invention). It will be seen, accordingly, that energizing of the registration delay relay RR immediately applies a signal through the contact RR3, the line 142, the shear dwell timer contact SD1, the line 141 to the previously-closed shear switch 127, and the line 143 to the shear solenoid valve 144 which is connected to apply operating fluid to the shear actuating cylinders 91*a* and 91*b* in a manner to lower the movable upper shear frame 85. The forward extent of the web 18, which was previously fed past the then-open shear 25 into the printer infeed tray 26, is now sheared from the web so that the infeed tray contains a single sheet of printing stock waiting feeding into the printer 13.

When the shear dwell timer SD times out, the contact SD1 opens and the shear solenoid valve 144 reverts to its initial state so that the cylinders 91*a* and 91*b* again open the shear. At this same time, a circuit is completed through contact SD2 to the print dwell timer PD, which immediately closes the normally-open contact PD1 and maintains that contact closed for a predetermined time (approximately 1.0 seconds, in the illustrative embodiment). The circuit is now completed through the line 145, the print dwell contact PD1, and the print solenoid valve 146, which is actuated to supply operating fluid to the print infeed actuator 28. The infeed rollers 27 are now lowered into contact with the just-severed sheet of printing stock which is in the infeed tray 26. The infeed rollers 27 are operated by the printer 13 at the proper time to move the sheet of printing stock from the infeed tray 26 into printing registry with the printing drum 23, as discussed previously, and the operating duration of the print dwell timer PD must be at least long enough to allow one complete printing cycle of the printer 13. As soon as the print dwell timer PD times out, the infeed rollers 27 are again raised to accommodate the new forward end of the web 18 fed from the transport assembly 12.

When the registration delay relay RR times out, assuming that no hold signal was received from the code scanner control 119, the brake-clutch control 116 again receives a signal condition which operates the transport assembly 12 to move the web 18 therethrough and into the infeed tray 26 until the registration scanner 78 again detects a registration bar 79 on the web.

The sheet counter 131 is a counter of the type having a count register 148 which can be preset to a desired count condition, and which is decremented each time a signal is received on the count input lines 147 which are connected in parallel with the print solenoid valve 146. The counter switch 130 of the sheet counter 131 is operatively coupled with the count register 148 so that the counter switch becomes opened when the count register is decremented to a zero count condition, thereby opening the circuit to the brake-clutch control and positively interrupting the operation of the transport assembly 12.

Although the operation of the illustrative embodiment has been described with reference to printing stock which contains periodically-repeated preprinted registration bars 79, this apparatus can also be used with blank printing stock through the provision of a web length counter 153 which includes a count wheel 154 disposed to be rotated by frictional engagement with the web 18 moving through the transport assembly 12. The count wheel 154 is mechanically coupled to a pulse generator 155, which outputs a signal pulse to the pulse counter 156 in response to each predetermined increment of count wheel rotation. The cumulative number of pulses counted by the pulse counter 156 is supplied to a count comparator 157, which also receives a predetermined pulse count condition from the adjustable set input 158. The count comparator 157 functions in a manner known to those skilled in the art to provide an output signal condition on the line 159 only when the number of pulses accumulated in the pulse counter 156 becomes equal to the pulse count condition previously set on the set input 158.

The output signal condition on the line 159 is supplied to the reset input of the pulse counter 156, causing that counter to be reset to a zero-count state. The output signal condition on line 159 is also supplied to the contact 134*b* of the selector switch 134, so that the presence of a count output condition from the comparator 159 can be supplied to the selector switch 134 and the signal amplifier 135 to energize the registration delay relay RR, in the same manner as previously described with respect to an energizing signal received from the registration scanner 78.

It will be understood that the pulse count condition supplied to the comparator by the set input 158 corresponds to a desired length of web to be fed into the infeed tray 26 of the printer. When the desired sheet length is attained, as indicated by the accumulated pulse count on the counter 156, the transport assembly is stopped and the shear 25 is operated in the previously-described manner to shear the forward end of the web in the infeed tray. The infeed roller 27 is then lowered to allow the just-sheared sheet to be fed into the printer 13, in the previously-described manner, after which the transport assembly 12 is again operated to advance the web into the infeed tray 26. The foregoing feed-shear cycle can be repeated until the printing apparatus is manually stopped, or until a previously-set count on the sheet counter 131 is decremented to zero.

It will be apparent that the foregoing relates only to a disclosed illustrative embodiment of the present invention, and that numerous changes and modifications may be made therein without departing from the spirit and the scope of the invention as defined in the following claims.

We claim:

1. Apparatus for providing printed sheets from a continuous web of printing stock, comprising:

support means to receive and dispense a continuous web of printing stock;

means operative to receive the continuous web of stock from said support means and selectively operative to withdraw a length of said stock from the continuous web;

means responsive to the passage of stock withdrawn from the continuous web to provide a first signal condition indicating that a certain length of stock has been withdrawn from the continuous web;

stock cutting means positioned in operative relation to said stock withdrawn from the continuous web and operative in response to said first signal condition to cut said certain length of stock from the web to furnish a separate sheet of said stock;

means operative to provide a second signal condition indicating that said stock cutting means has operated;

printing means positioned to serially receive said separate sheet cut from the continuous web by said cutting means and operative in response to said second signal condition to perform a printing operation on said separate sheet;

said means responsive to the passage of withdrawn stock being operative to measure the length of stock withdrawn from the continuous web and to provide said first signal condition when the measured length corresponds to a previously determined length for said separate sheet;

said means responsive to the passage of withdrawn stock comprising pulse generating means operative to generate a pulse signal in response to passage of each increment of withdrawn web, said increment of length being less than said previously determined length for said separate sheet;

counting means operative to maintain a pulse count signal condition in response to said pulse signals from said pulse generating means; and comparator means responsive to said pulse count signal condition and to a present reference count signal condition to provide said first signal condition when the pulse count corresponding to said pulse count signal condition is equal to said reference count signal.

2. Apparatus for providing printed sheets from a continuous web of printing stock, comprising:

support means to receive and dispense a continuous web of printing stock;

means operative to receive the continuous web of stock from said support means and selectively operative to withdraw a length of said stock from the continuous web;

means responsive to the passage of stock withdrawn from the continuous web to provide a first signal condition indicating that a certain length of stock has been withdrawn from the continuous web;

stock cutting means positioned in operative relation to said stock withdrawn from the continuous web and operative in response to said first signal condition to cut said certain length of stock from the web to furnish a separate sheet of said stock;

means operative to provide a second signal condition indicating that said stock cutting means has operated;

printing means positioned to serially receive said separate sheet cut from the continuous web by said cutting means and operative in response to said second signal condition to perform a printing operation on said separate sheet;

sensing means selectively responsive to coded variable indicia which may be disposed on the continuous web and which corresponds to a particular kind of web material, said sensing means providing a code signal condition in response to a sensed coded indicia which differs from a predetermined coded indicia;

circuit means operative in response to said code signal condition to interrupt the operation of said web withdrawing means, said circuit means including a switching means which normally assumes an operative state for a certain time in response to said first signal condition from said means responsive to withdrawn stock;

said switching means being operative during said certain time to enable said sensing means to be responsive to said coded variable indicia; and said switching means being responsive to said code signal condition to become latched to said operative state irrespective of said certain time.

* * * * *